United States Patent [19]

Frys

[11] 4,395,873

[45] Aug. 2, 1983

[54] PROCESS OF AND APPARATUS FOR SPINNING A BUNDLE OF TEXTILE FIBRES HAVING NO APPRECIABLE TWIST

[75] Inventor: Ludovic Frys, Marcq en Baroeul, France

[73] Assignee: Filature Saint Andre, Saint Andre, France

[21] Appl. No.: 160,467

[22] Filed: Jun. 18, 1980

[51] Int. Cl.[3] ..... D02G 1/04

[52] U.S. Cl. ..... 57/334; 57/284; 57/337; 57/328; 57/341

[58] Field of Search ..... 57/6, 12, 261, 284, 57/279, 280, 328, 331, 332, 334, 335, 337, 341, 342, 343, 344, 348, 13–15, 315, 327, 329, 330, 338, 339, 351

[56] References Cited

U.S. PATENT DOCUMENTS

| | | | |
|---|---|---|---|
| 1,744,619 | 1/1930 | DeCourcy | 57/334 |
| 2,049,945 | 8/1936 | Casablancas | 57/342 |
| 2,552,210 | 5/1951 | Parker | 57/328 |
| 2,936,570 | 5/1960 | Arthur et al. | 57/341 X |
| 3,029,591 | 4/1962 | Scragg et al. | 57/334 X |
| 3,177,642 | 4/1965 | Korikovsky | 57/328 X |
| 3,307,344 | 3/1967 | Southard | 57/280 |
| 3,685,268 | 8/1972 | Seguin | 57/11 |
| 3,735,575 | 5/1973 | Hattori | 57/334 X |
| 3,802,175 | 4/1974 | Doschko | 57/341 X |
| 4,002,017 | 1/1977 | Weinz | 57/341 |
| 4,322,944 | 4/1982 | Sraitr et al. | 57/328 |

OTHER PUBLICATIONS

French Publication No. 2,435,542, Published May 9, 1980, Filature Saint Andre.

*Primary Examiner*—Donald Watkins

*Attorney, Agent, or Firm*—Toren, McGeady and Stanger

[57] ABSTRACT

A bundle of textile fibres 1, e.g. a sliver or roving supplied by a drafting apparatus 2, is passed over a frictional surface 7 provided by a rotary disc 6 so that the surface 7 moves transversely to the path of movement of the bundle 1. The resultant twist is prevented from running back into the drafting apparatus 2 by exit rollers 5, and from running forward to take-up bobbin 16 by draw-off rollers 13, 14. The resultant product is a fancy thread containing a false twist but on which the sum total of the residual twist is substantially zero. Thread 17 is used for threading-up the apparatus, but such a thread may also be fed to the disc 6 to form a composite with the bundle 1. Modifications provide for two or more bundles to be supplied simultaneously to the same disc 6 with one or all contacting the roughened surface 7 and for one or more bundles to be treated in successive discs 6 and combined at one of the successive discs 6.

21 Claims, 10 Drawing Figures

PROCESS OF AND APPARATUS FOR SPINNING A BUNDLE OF TEXTILE FIBRES HAVING NO APPRECIABLE TWIST

This invention concerns a process of and apparatus for spinning a bundle of textile fibres having no appreciable initial twist, as well as a spun product produced therewith.

More particularly the aim of the invention is to provide a novel spinning process which is so performed as to convert fibres without twist into a novel spun product having fancy effect, and to provide appropriate apparatus for carrying out the process.

With this object in view, the present invention provides a process of spinning a bundle of textile fibres having no appreciable initial twist, such as a sliver or roving obtained by drafting or carding, characterised in that it comprises passing the bundle of fibres against a rough surface moving in a direction transverse to the direction of passage of the said bundle of fibres which are held against twisting in advance of the rough surface by supply means by which said bundle is supplied, whilst the spun product is also held against twisting at a point beyond the rough surface by draw-off means, whereby the bundle of fibres is converted, by reason of the false twist inparted thereto, into a sheath-like spun product of tangled and matted fibres.

The term "rough surface" as used herein means a surface of which the state or structure is such that the said surface creates a driving effect by friction on a bundle of fibres led into contact with it. Such a surface could be provided, for example, by a layer of abrasive articles or by provision of knurling, ridges, grooves or like on a moving member.

In a particular way of carrying the process into effect, with a view to favouring the initiation of the spinning process, or to obtain different effects, a supply thread is passed against the moving rough surface at the same location as that of the bundle of fibres.

The invention also provides apparatus for carrying out the above-discussed process. This apparatus comprises supply means for supplying said bundle of fibres, draw-off means for the spun product, and, disposed between said supply means and said draw-off means, a moving member presenting a moving rough surface against which the said bundle of fibres rubs and of which the direction of movement is transverse to the direction of passage of the part of the bundle of fibres which rubs against the moving surface.

In an advantageous embodiment, the moving member is a rotary body pierced axially for the passage therethrough of the spun product and means for rotating said body about its own axis. Such a member can be of relatively small dimensions and may be adapted to rotate very quickly so that it involves relatively little expense and occupies little space, while assuming rapid production. Using this apparatus, one can manufacture a wide range of fancy threads, which may be of constant diameter or bulked, or of boucle form, or ruffled. The sum total of the individual twist in the product is practically zero, so that it has remarkable bulk or expansion properties.

Other advantages and characteristics of the invention will be appreciated from the following description with reference to the accompanying drawings which illustrate a number of different embodiments of the apparatus of the invention and its use in carrying out the process of the invention.

Figure 1:
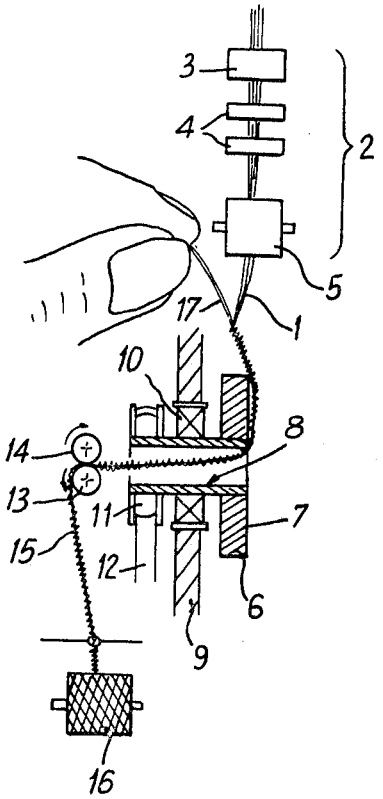
FIG. 1 is a diagrammatic part-sectional front view of a first embodiment of the spinning apparatus of the invention, spinning a single fibre bundle.
Figure 2:
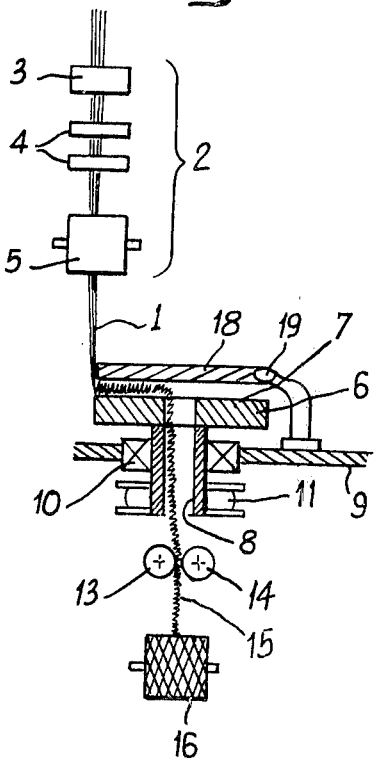
FIG. 2 is a view comparable with FIG. 1 but showing the apparatus differently disposed in relation to the direction of a bundle of fibres thereabove and having an attachment.
Figure 2A:
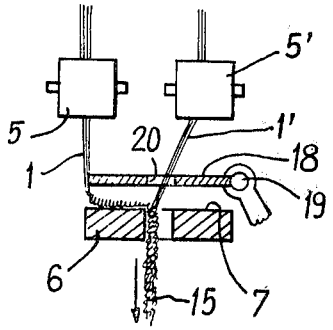
Figure 2B:
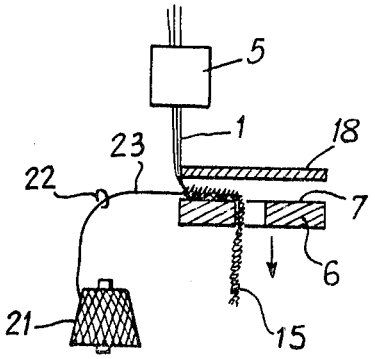
Figure 3:
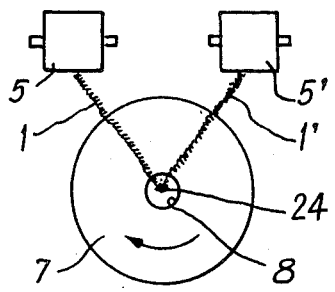
Figure 4:
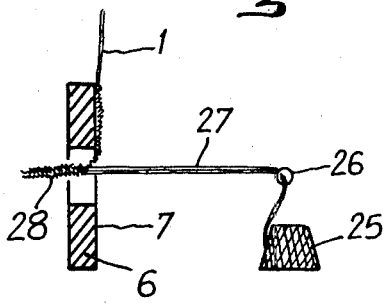
Figure 5:
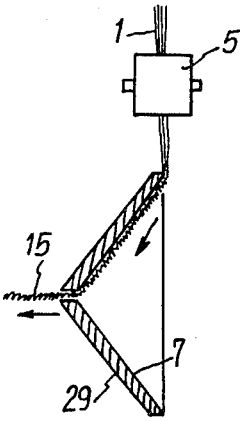
Figure 5A:
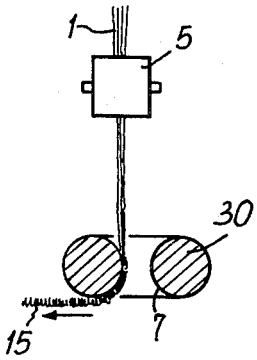
Figure 5B:
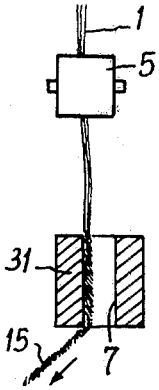
Figure 6:
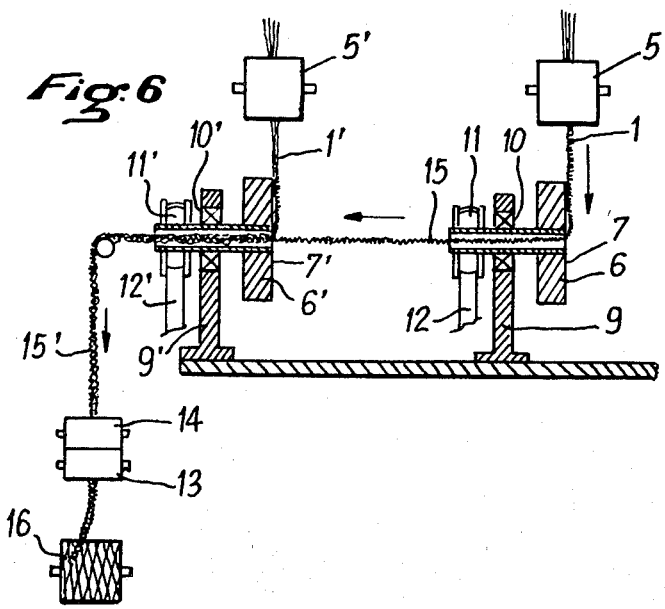

FIG. 2*a* is a fragmentary view illustrating the apparatus of FIG. 2 modified for the addition of a second bundle of fibres, not subjected to friction, which joins the first fibre bundle and combines with it in a central passage through a rotating disc forming part of the apparatus;

FIG. 2*b* similarly illustrates the apparatus of FIG. 2 modified for the addition of a second component which in this case is a thread which accompanies the bundle of fibres on its journey over the roughened surface and combines therewith;

FIG. 3 is a side elevation illustrating the principal parts of a variation of the apparatus of FIG. 1 which utilises a second bundle of fibres which are subjected to friction and combine with the first fibres bundle;

FIG. 4 is a sectional front view of the principal part of the apparatus of FIG. 1 being used in a process in which a thread for special effect is added, without being subjected to friction, directly in a central space through a rotating disc of the apparatus, to meet with the bundle of fibres, with which it combines;

FIGS. 5, 5*a* and 5*b* are sectional elevations illustrating three different ways of providing the rough surface in the apparatus of the invention; and FIG. 6 is a diagrammatic part-sectional view of a further modification embodying two devices similar to that of FIG. 1.

The preferred embodiment of the apparatus of the invention illustrated in FIG. 1 serves to perform a spinning process on a roving or sliver of textile fibres 1 supplied by drafting apparatus 2 of which 3, 4 and 5 are upper entry, intermediate and exit cylinders respectively.

The spinning comprises essentially a movable member disposed at the exit of the drafting apparatus 2. In this embodiment the movable member rotates about a horizontal axis, is pierced axially and is constituted by a flat annular disc 6 of which one lateral face 7 is rendered rough in the manner described above, that is to say by providing a layer of abrasive thereon or by knurling, scoring, slotting or otherwise working the said face 7.

This disc 6 is carried by a tubular shaft 8 mounted so as to rotate in a fixed part 9 of the machine by means of a ball or like bearing 10. On the end of the shaft 8 remote from the disc 6 is a fixed pulley 11 engaged by a drive belt 12 movement of which serves to rotate the disc 6.

In alignment with the end of the tubular shaft 8 remote from the rotating disc 6 is draw-off means in the form of a pair of draw-off rollers 13, 14 which serves to draw the resultant spun product 15 through the shaft 8, the product thereafter being wound on a bobbin 16.

This apparatus functions as follows:

The drafting apparatus 2 and the receiving bobbin 16 being stopped and the disc 6 being driven, a supply thread 17 from the bobbin 16 is passed between the take up rollers 13, 14 also stopped, then introduced into and threaded through the tubular shaft 8. As shown in FIG.

1, the thread 17 is then held so as to be subjected to rubbing by the disc 6 and is presented to the exit zone of the drafting apparatus 2.

The drafting apparatus 2 is now set running as also are the take-up rollers 13, 14 and the receptor bobbin 16.

The supply thread 17 rubbing against the rough moving surface 7 of the disc 6 acquires a false twist which spreads upwards and downwards from the surface 7. The bundle of fibres constituted by the roving or sliver 1 which comes from the drafting apparatus 2, meets the thread 17, which is twisting, and wraps itself thereafter around forming a sort of muff or sheath which, when the thread 17 is slackened, progresses against the moving surface 7 towards the centre of the disc 6 and then moves towards the take-up rollers 13, 14. This muff or sheath, on leaving the active zone of friction, progressively loses its false twist; this causes unrolling or untwisting of the fibres which form it. This is a complex unrolling, and may be considered not to be strictly the reverse of the twisting process; it results in tangling of the fibres, which forms them into a random mass, or matts them and gives to the final spun product 15 the properties hardwearing capacity and volume. In the product, the sum total of the individual twist is practically nil, which confers on it a very bulky or expansion properties.

The speed of draw-off of the rollers 13, 14 may be adjusted so as to be equal to, greater than or less than the output speed of the rollers 5. This adjustment influences the appearance and thickness of the product.

FIG. 2 illustrates an alternative way of arranging the rotating disc 6, with its axis of rotation vertical. In this case, a plate 18 is located at a suitable spacing from the rotating disc 6 to provide a second surface in a plane approximately parallel to the surface 7 of the disc 6. Its principal function is to direct the fibre bundle 1 emerging from the drafting apparatus 2 against the surface 7 of the rotating disc 6 since without this plate 18 the fibres bundle 1 would arrive directly at the tubular shaft 8.

The plate 18 serves also the supplementary function of pressing the bundle of fibres 1, to a certain extent, against the surface 7.

A hinge 19 permits swinging of the plate 18 out of the way to facilitate the threading-in of the priming thread 17.

FIG. 2*a* illustrating a variation in which two bundles 1 and 1′ of fibres are spun simultaneously the second bundle 1′ not being subjected to friction. This second bundle 1′ passes as a second component through a hole 20 in the plate 18 in order to join the first component bundle 1 and combines with the latter in the central space of the rotatable disc 6.

FIG. 2*b* illustrates another variation. Instead of the initial priming process using the thread 17 as described in relation to the apparatus of FIG. 1, the process can use a thread 23 accompanying the bundle of fibres 1 all the time. This thread 23, by combining itself with the bundle of fibres, permits the production of a supplementary effect. The thread 23 is fed from a bobbin 21, by way of a thread guide 22, towards the centre of the disc 6 after which it passes between the draw-off rollers then on the receiving bobbin. Whether producing a supplementary effect or not, this thread 23 offers the advantage, if necessary, of preventing unwanted deviation of the fibre bundle being spun in the apparatus.

In general, the position of the rotary disc 6 relative to the exit of the drafting apparatus 2 does not change the nature of the process. The positions illustrated in FIGS. 1, 2, 2*a* and 2*b* are only examples and are not restrictive. The essential is that the bundle of fibres 1 should be constrained to run on an abrasive surface. This constraint may be achieved by the positioning of or by the assistance of a device such as the plate 18 of FIG. 2 (this device having only the value of an example) but such a plate 18 is not essential. The abrasive surface runs in a direction approximately transversely to the path of movement of the fibre bundle.

In the examples of FIGS. 1 and 2, a single bundle of fibres 1 reaches a single zone of the roughened surface 7 of the disc 6. In the example of FIG. 3, two bundles 1 and 1′ are provided, these coming from two different drafting arrangements by way of exit rollers 5 and 5′. The action of the abrasive surface 7 is to produce a false twist followed by untwisting in each of the bundles 1 and 1′. The two bundles, subjected to this action, join each other at point 24 in the entry end of the tubular shaft 8 where they combine together.

In FIG. 4 only the disc 6 is shown with its moving roughened surface 7. A thread 27 is led from a bobbin 25 by a guide-thread 26, so as not to be subject to friction, until it meets, at the centre of the disc 6, with the bundle 1 which has been subject to the action of the abrasive surface 7. This supplementary thread 27 combines, as a result of the complex actions of false twisting and untwisting with the bundle 1, thus giving birth to a new product 28.

To recapitulate the different combinations possible, one can provide for the action of the abrasive disc on a single bundle, or separately or together on a plurality of bundles of fibres; no, one or several supply threads accompany the bundle or bundles during progression from the edge of the disc towards the tubular space; no, one or several supply threads may join with the first bundle or the bundles, directly in the tubular space, and without being subjected to the action of the disc; no, one or several bundles of fibres may join the first bundle or bundles directly in the tubular space without being subject to the frictional action of the disc.

Three possible variations for the revolving roughened surface are illustrated in FIGS. 5, 5*a* and 5*b*. These being only examples and in no way restrictive; the surfaces 7 are provided respectively by a flared funnel 29, by a torus 30, and by a cylinder 31.

The axes of rotation of the movable bodies relative to the path of the fibre bundle emerging from the drafting apparatus can be arranged in various ways. What is essential is that the bundle of fibres should rub against the abrasive surface of the respective revolving body, this being determined by the path of movement of the fibre bundle arising from the positioning of the moving body 6 (as in FIG. 1) or by means (such as the plate 18 in FIG. 2) which curves the bundle path towards the body 6.

FIG. 6 illustrates an arrangement in which the apparatus of FIG. 1 is duplicated, it being understood that further units of said apparatus may be added.

The exit rollers 5 supply the disc 6 with a bundle of fibres 1. This bundle 1, transformed into a thread and drawn by the take-up rollers 13, 14 arrives in the tubular space of the second disc 6′ where it meets a second bundle of fibres 1′, provided by the exit rollers 5′, this latter bundle 1′ having been subjected to friction by the abrasive surface of the disc 6′. These two twisted products combine together and the final product is fed by the draw-off rollers 13, 14 to the receiving bobbin 16.

Obviously the arrangements described in relation to FIGS. 2, 2*a*, 2*b*, 3, 4, 5, 5*a* and 5*b* can substitute for one or more of the spinning elements in FIG. 6.

I claim:

1. A process of spinning a bundle of textile fibres having no appreciable initial twist, such as a sliver or roving obtained by drafting or carding, the process comprising passing the bundle of fibres against a continuous rough surface located on a rotatable solid of revolution and rotating the solid of revolution so that the continuous rough surface is moving in a direction transversely of the direction of movement of the bundle of fibres passing against the continuous rough surface, holding the bundle of textile fibres against twisting at a location in advance of the continuous rough surface using the means by which the bundle is supplied, and holding the bundle of textile fibres against twisting at a location beyond the continuous rough surface by means used for drawing off the bundle of fibres, and thereby converting the bundle of fibres, by reason of the false twist imparted thereto, into a sheath-like spun product of tangled and matted fibres.

2. A process of spinning a bundle of textile fibres having no appreciable initial twist, such as a sliver or roving obtained by drafting or carding, the process comprising passing the bundle of fibres against a continuous rough surface located on a rotatable solid of revolution and rotating the solid of revolution so that the continuous rough surface is moving in a direction transversely of the direction of movement of the bundle of fibres passing against the continuous rough surface, holding the bundle of textile fibres against twisting at a location in advance of the continuous rough surface using the means by which the bundle is supplied, and holding the bundle of textile fibres against twisting at a location beyond the continuous rough surface by means used for drawing off the bundle of fibres, and thereby converting the bundle of fibres, by reason of the false twist imparted thereto, into a sheath-like spun product of tangled and matted fibres, and causing the bundle of fibres to contact a second surface parallel to and facing the moving rough surface.

3. A process as claimed in claim 1 or 2 characterised therein by combining at least one supplementary bundle of fibres with the first-mentioned bundle, at the place where the latter leaves the moving rough surface, and drawing-off all of the bundles of fibres using the same draw-off means.

4. A process as claimed in claim 3 characterised thereby by passing the bundle or bundles of supplementary fibres directly to the place where the first-mentioned bundle of fibres leaves the moving rough surface.

5. A process as claimed in claim 3 characterised therein by moving the supplementary bundle or bundles of fibres against the moving rough surface.

6. A process of spinning a bundle of textile fibres having no appreciable initial twist, such as a sliver or roving obtained by drafting or carding, comprising the steps of passing the bundle of fibres against a rough surface moving in a direction transverse to the direction of passage of the bundle of fibres which are held against twisting in advance of the rough surface by supply means by which the bundle is supplied whilst the spun product is also held against twisting at a point beyond the rough surface by draw-off means, whereby the bundle of fibres is converted, by reason of the false twist imparted thereto, into a sheath-like spun product of tangled and matted fibres, at least one supplementary bundle of fibres is combined with the first-mentioned bundle, at the place where the latter leaves the moving rough surface, all of the bundles of fibres being subjected to the action of the same draw-off means, the bundle or bundles of supplementary fibres is or are passed directly to the place where the first-mentioned bundle of fibres leaves the moving rough surface, and a supplementary bundle of fibres is led to the place where the first-mentioned bundle of fibres leaves the moving rough surface, after the supplemental bundle has passed against a moving rough surface in a manner similar to the first-mentioned bundle.

7. A process as claimed in claim 6 characterised therein by causing the bundle of fibres to contact a second surface parallel to and facing the moving rough surface.

8. A process as claimed in claim 1, characterised therein by passing a supply thread against the moving rough surface at the same location as that of the first-mentioned bundle of fibres.

9. A process of spinning a bundle of textile fibres having no appreciable initial twist, such as a sliver or roving obtained by drafting or carding, the process comprising passing the bundle of fibres against a continuous rough surface located on a rotatable solid of revolution and rotating the solid of revolution so that the continuous rough surface is moving in a direction transversely of the direction of movement of the bundle of fibres passing against the continuous rough surface, holding the bundle of textile fibres against twisting at a location in advance of the continuous rough surface using the means by which the bundle is suplied, and holding the bundle of textile fibres against twisting at a location beyond the continuous rough surface by means used for drawing off the bundle of fibres, and thereby converting the bundle of fibres, by reason of the false twist imparted thereto, into a sheath-like spun product of tangled and matted fibres, passing a supply thread against the moving rough surface at the same location as that of the first-mentioned bundle of fibres, and passing the supply thread against the moving rough surface only during a short priming period in the spinning process.

10. Apparatus for spinning a bundle of textile fibres having no appreciable initial twist, such as a sliver or roving obtained by drafting or carding characterised in that it comprises a supply means for supplying said bundle of fibres, draw-off means for the spun product, and disposed between said supply means and said draw-off means, a rotatable solid of revolution having a rough surface movable therewith during rotation and positioned so that the bundle of fibres rubs against the rough surface, and said rough surface being movable in the direction transverse to the direction of passage of the bundle of fibres which rubs against the moving surface.

11. Apparatus for spinning a bundle of textile fibres having no appreciable initial twist, such as a sliver or roving obtained by drafting or carding characterised in that it comprises a supply means for supplying said bundle of fibres, draw-off means for the spun product, and disposed between said supply means and said draw-off means, a rotatable solid of revolution having a rough surface movable therewith during rotation and positioned so that the bundle of fibres rubs against the rough surface, and said rough surface being movable in the direction transverse to the direction of passage of the bundle of fibres which rubs against the moving surface, and supplementary supply means for supplying at least one supplementary bundle of fibres to the place where the first-mentioned bundle leaves the movable rough surface of the rotatable solid of rotation.

12. Apparatus as claimed in claim 11 characterised in that the supplementary supply means is located in such a manner that at least one supplementary bundles of fibres also passes against the movable rough surface.

13. Apparatus as claimed in claim 10 characterised in that it comprises a means for supplying a thread at the same location as that of the bundle of fibres.

14. Apparatus as claimed in claim 10 characterised in that the rotatable solid of revolution is pierced axially for passage therethrough of the spun product and means for rotating said solid of revolution about its own axis.

15. Apparatus as claimed in claim 14 characterised in that the movable rough surface of the said solid of revolution is a flat transverse surface.

16. Apparatus as claimed in claim 14 characterised in that the movable rough surface of the said solid of revolution is constituted by the inner wall of a flared funnel.

17. Apparatus as claimed in claim 14 characterised in that the movable rough surface of the said solid of revolution is constituted by the inner wall of a torus.

18. Apparatus as claimed in claim 14 characterised in that the movable rough surface of the said solid of revolution is constituted by the inner wall of a cylindrical conduit.

19. An apparatus for spinning a bundle of textile fibres having no appreciable initial twist, such as slivers or rovings obtained by drafting or carding, comprising a plurality of separate supply means each arranged to supply a separate bundle of textile fibres, a plurality of separate rotatable solids of revolution each associated with a different one of said supply means, each said rotatable solid of revolution having a continuous rough surface thereon so that the bundle of textile fibres from the associated said supply means rubs against said rough surface with said rough surface arranged so that its direction of movement is transverse to the direction of movement of the bundle of textile fibres passing thereagainst, said rotatable solid of revolution arranged so that the bundle of textile fibres leaving each one of said solids of revolution is directed to the adjacent said solid of revolution, and common draw-off means to receive and draw the spun product leaving the last one of said rotatable solids of revolution.

20. A spun product in the form of a fancy thread formed in accordance with the process of claims 2, 4, 5, 6, 8 or 9.

21. A spun product in the form of a fancy thread produced on an apparatus as claimed in claims 7, 11, 12, 13, 14, 15, 16, 17, or 19.

* * * * *